United States Patent [19]

Kamin

[11] 4,198,653

[45] Apr. 15, 1980

[54] VIDEO ALARM SYSTEMS

[75] Inventor: Gerhard R. Kamin, Traisa, Fed. Rep. of Germany

[73] Assignee: Robert Bosch GmbH, Stuttgart, Fed. Rep. of Germany

[21] Appl. No.: 892,787

[22] Filed: Apr. 3, 1978

[30] Foreign Application Priority Data

Apr. 4, 1977 [DE] Fed. Rep. of Germany ..... 2715083

[51] Int. Cl.[2] ..... H04H 7/18

[52] U.S. Cl. ..... 358/105; 358/108; 340/541

[58] Field of Search ..... 358/105, 108, 109; 340/541, 600

[56] References Cited

U.S. PATENT DOCUMENTS 3,988,533 10/1976 Mick et al. ..... 358/108

FOREIGN PATENT DOCUMENTS 1913768 3/1978 Fed. Rep. of Germany ..... 358/108

*Primary Examiner*—Robert L. Griffin
*Assistant Examiner*—Edward L. Coles
*Attorney, Agent, or Firm*—Quaintance, Murphy & Richardson

[57] ABSTRACT

The invention concerns a video alarm system for discriminating a video signal for detecting a movement or change in a scene under supervision by a television camera, the television picture being sub-divided into a plurality of areas which are individually evaluated to determine whether or not an alarm is to be raised.

In order to avoid the release of a spurious alarm by fluctuations in basic brightness of the scene, caused for example by intermittent cloud cover, a particular area of the picture is investigated for variations in average brightness. If a brightness change greater than a predetermined threshold is detected in the selected area, any alarm signal initiated by the alarm system is suppressed.

7 Claims, 3 Drawing Figures

VIDEO ALARM SYSTEMS

FIELD OF THE INVENTION

This invention relates to a video alarm system for discriminating a video signal for detecting a movement or change in a scene which is under supervision by a television camera, wherein the television picture corresponding to the video signal produced by the camera is subdivided into a plurality of areas of which the respective video signals are individually evaluated according to predetermined criteria.

DESCRIPTION OF PRIOR ART

A system of this kind is disclosed in German OS No. 19 13 768. However, in this known system random variations in the brightness of the scene can cause the release of spurious alarms. Such random changes in the scene may be expected, for example, when supervising a scene under a partially obscured sky. In such a case the sunlight is intermittently screened by moving cloud banks so that shadows can be thrown over objects situated within the supervision field of the television camera, such shadows appearing and vanishing according to the cloud cover. As a result of this there is also a change in the video signal derived by the television camera. Upon the detection of brightness variations, an alarm device which evaluates the resulting video signal releases an alarm although, in fact, no event relevant to an alarm has taken place. In the known system it is possible to prevent the transmission of such a spurious alarm by effecting a reduction in the sensitivity. However, this method will at the same time prevent the transmission of a genuine alarm when changes take place in the scene which are relevant to such an alarm.

SUMMARY OF THE INVENTION

According to the present invention there is provided in an alarm system for discriminating a video signal produced by a television camera for detecting a movement or a change in a scene which is under supervision by the television camera, the alarm system comprising means for subdividing the television picture corresponding to the video signal into a plurality of areas and means for individually evaluating the respective video signals corresponding to those areas according to predetermined criteria, the improvement comprising means for detecting a video signal change originating from a predetermined brightness change in a selected picture area of adjustable size and position, and means for suppressing any alarm initiated in respect of at least one remaining area of the television picture when said predetermined brightness change is detected.

The invention has the advantage that there may be achieved a relative insensitivity of the video alarm system in response to changes in the visual structure of the scene caused by intense and sudden fluctuations in brightness, whilst retaining at the same time a high sensitivity with respect to events which are relevant to a genuine alarm.

BRIEF DESCRIPTION OF THE DRAWINGS

An embodiment of the invention will now be described with reference to the accompanying drawings, in which.

DESCRIPTION OF PREFERRED EMBODIMENT

Figure 1:
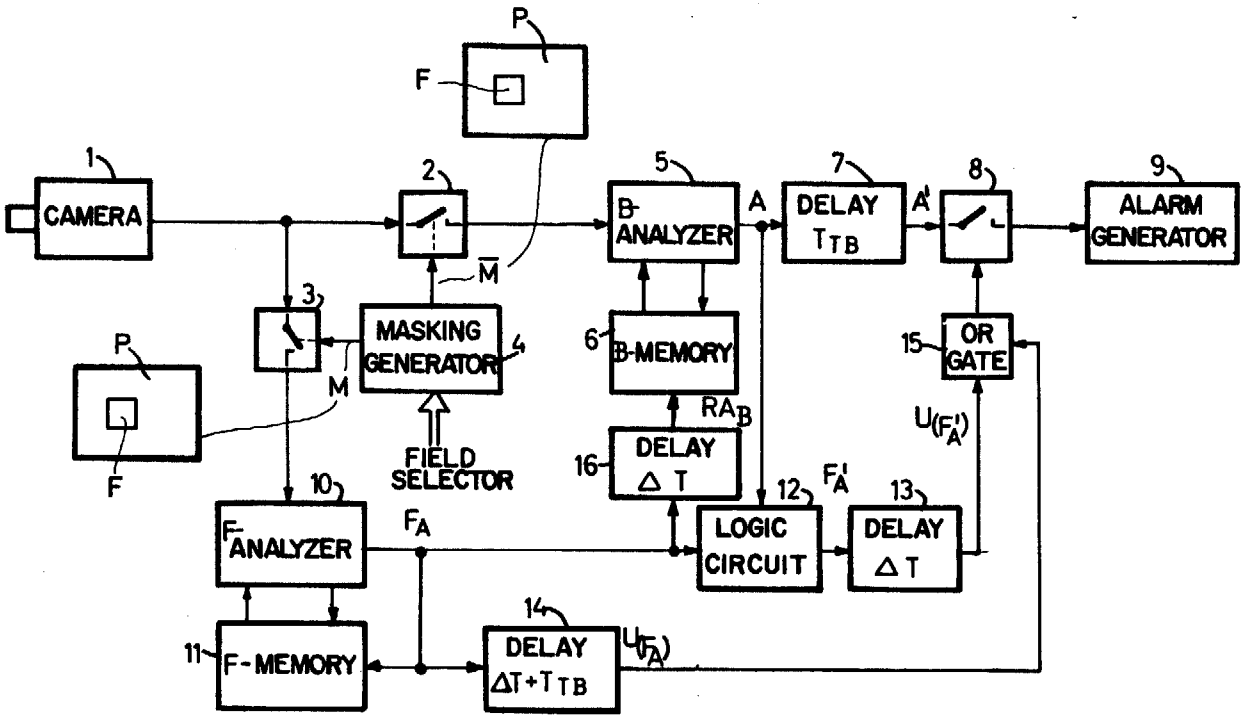
FIG. 1 is a block schematic diagram of a video alarm system according to the invention.

In FIG. 1 a television camera 1 is slighted for surveillance of an object or scene to be supervised. A video signal produced by the television camera 1 is delivered to a first gate circuit 2 and a second gate circuit 3. The contact paths of the gate circuits 2 and 3 are controlled by mutually complementary masking signals M and $\overline{M}$ which are generated in a masking generator 4 of known type. The masking generator 4 serves for electronic subdivision of the television picture corresponding to the video signal into a plurality of areas. By means of further circuits (not shown but of known type) it is possible to adjust the position and size of the picture areas defined by the masking generator 4. In the present example here considered the television picture is subdivided into a picture area F of rectangular form and a further picture area consisting of the remainder of the television picture P surrounding the area F.

The gate circuit 2 is so controlled by the masking signal $\overline{M}$ that those parts of the video signal which belong to the area F are suppressed. On the other hand, at the output of the gate circuit 3 there are available those parts of the video signal belonging only to the picture area F. The video signal from 2 is delivered to a device 5 for picture analysis where the video signal is evaluated according to any suitable criteria for determining whether an alarm is to be raised. The evaluation is performed with the assistance of a comparison signal deposited in a picture store 6. At the end of each evaluating interval, for example at the end of each field period, an alarm pulse A is, if the criteria are met, delivered through a delay stage 7 having a delay of one field period $T_{TB}$ and applied and delivered through a normally closed gate circuit 8 to an alarm condition indicator generator 9 for releasing an optical and/or acoustic alarm.

The video signal available at the output of the gate circuit 3 is delivered to an analysis device 10 for evaluation of the selected area F. In this device 10 a comparison is effected between the integral value of the video signal, representing the average area brightness, and a reference value deposited in a so-called area store 11. If the comparison results in a predetermined difference, a suppression pulse $F_A$ appears at the output of the device 10. The pulse $F_A$ is logically linked in a logic circuit 12 with the alarm pulse A available at the output of the device 5, and the result $F_A'$ of this logic operation is delayed in a following delay device 13 by a time period $\Delta T$ equal to the time interval between the termination of a selected area within a field and the termination of the field itself. Furthermore the suppression pulse $F_A$ available at the output of the device 10 is delayed in a delay device 14 by a field period $T_{TB}$ pulse $\Delta T$, and the same pulse $F_A$ is also delayed in a delay device 16 by the period $\Delta T$.

The pulse U ($F_A$) available at the output of the delay device 14, after passing through an OR gate 15, serves for controlling the gate circuit 8, whilst the pulse $R_{AB}$ available at the output of the delay device 16 serves for controlling the picture store 6. To another input of the OR gate 15 there is delivered or applied the pulse U ($F'_A$) which is available at the output of the delay device 13. By means of the OR gate any delayed alarm pulse A' is blocked or suppressed by opening of the gate 8 by either of the pulses $U(F_A)$ or $U(F_A')$.

Figure 2:
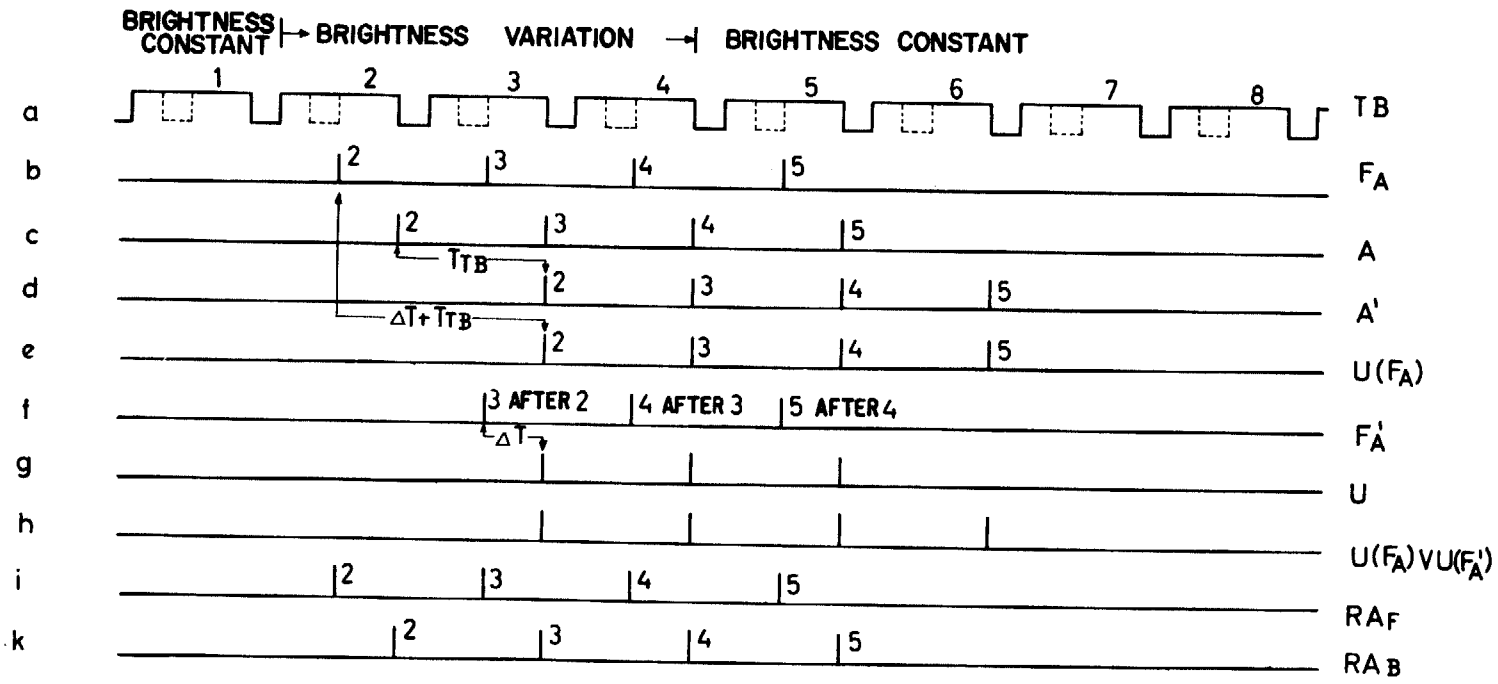
FIGS. 2 and 3 are voltage-time diagrams for explaining the operation of the block schematic diagram of FIG. 1.
Figure 3:
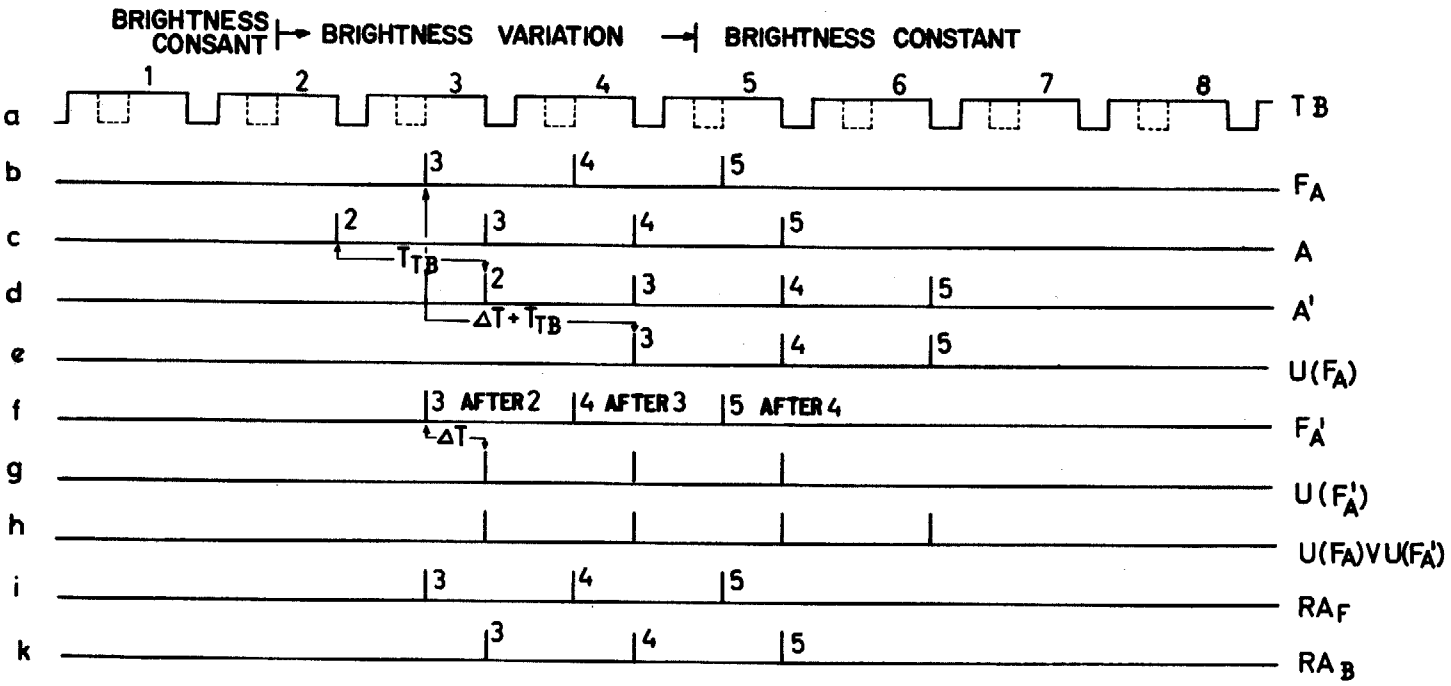

The operation of the alarm system shown in the block schematic diagram of FIG. 1 will now be more particularly described in the following with reference to the voltage-time diagrams of FIGS. 2 and 3 in the event of the occurrence of a random variation in brightness irrelevant to a genuine alarm. FIGS. 2 and 3 represent the conditions occurring when a random brightness variation occurs over different perods of the video signal and will be described separately, FIG. 2 being dealt with first.

The signal curve of FIG. 2*a* is intended to correspond to eight succeeding television fields which are scanned at vertical frequency. The dashed line within each field indicates the position of the selected picture area F during the field period. Let it be assumed that a random overall change in brightness in the picture begins in the blanking gap between fields 1 and 2 and terminates in the blanking gap between fields 4 and 5. Furthermore let it be assumed that the brightness variation detected in respect of the area F gives rise to pulses $F_A$ at the respective right hand lower corners of the picture areas F in the fields 2 and 5 (FIG. 2*b*). In the areas F of the fields 5 and subsequent fields, the average brightness is again constant in the signal available at the output of the gate circuit 3. In FIG. 2*c* there are shown the unwanted alarm pulses A which are assumed to be produced at the output of the picture analysis device 5 by the overall brightness change. In the present practical example under consideration alarm pulses appear in each case at the ends of the fields 2 to 5.

The alarm pulses A' represented in FIG. 2*d* are in each case delayed by one period of a field with respect to the alarm pulses A at the input of the delay device 7. The pulses $U(F_A)$ shown in FIG. 2*e* are delayed with respect to the pulses $F_A$ of FIG. 2*b* by a field period, and additionally by the period $\Delta T$. These pulses $U(F_A)$ coincide with the alarm pulses A' of FIG. 2*d*. Therefore the alarm pulses A' are not transmitted by the gate circuit 8 to the alarm transmitter 9 which is therefore unable to release an alarm.

Each pulse $F'_A$ shown in FIG. 2*f* is produced by the logic circuit 12 when a pulse $F_A$ follows an alarm pulse A. FIG. 2*g* shows pulses $U(F'_A)$ at the output of the delay stage 13. In consequence of the OR linkage effected by the OR gate 15, the pulses represented in FIG. 2*h* are delivered to the gate circuit 8 to interrupt transmission of the alarm post.

The voltage-time diagrams shown in FIGS. 2*i* and 2*k* serve for illustrating the functioning of the stores 11 and 6 respectively. The pulses shown in FIG. 2*i* initiate renewal or updating of the comparison information stored in the area store 11 in accordance with the changed brightness conditions from one such pulse to the next, and the pulses shown in FIG. 2*k* initiate a similar updating of the picture store 6. Thus this updating of information is effected only when variations in brightness render this actually necessary, although it could be effected for each field irrespective of brightness changes. The pulses of FIG. 2*i* are coincident with the alarm pulses $F_A$ of FIG. 2*b*, and the pulses of FIG. 2*k* are coincident with the pulses $F_A$ of FIG. 2*b* when delayed by $\Delta T$ in the delay device 16.

The voltage-time diagram of FIG. 3*a* again shows a succession of eight fields. However, in this sequence the variation in brightness begins shortly after the scanning of the area F in the field 2 and is completed shortly before the scanning of the area F in the field 5. In this case a suppression pulse $F_A$ (FIG. 3*b*) in respect of field 2 is missing, because at the instant of the evaluation of the area F of that field a brightness change had not yet occurred. Nevertheless, at the end of the second field an alarm pulse A (FIG. 3*c*) appears because it is already possible for the device 5 to detect the brightness variation in the remainder of the picture area. In FIG. 3*d* there are shown the alarm pulses A' delayed by one field period, and in FIG. 3*e* there are shown the suppression pulses $U(F_A)$ delayed by one field period plus $\Delta T$. Notwithstanding the delay of the alarm pulses A by a field period $T_{TB}$ to provide the alarm pulses A', it is still not possible to suppress the first alarm pulse A' originating from the second field. This is the reason for the production of the additional suppression pulses $U(F'_A)$ (FIG. 3*g*) which was not strictly necessary under the assumed conditions of FIG. 2.

The pulses $F'_A$ (FIG. 3*f*) are produced by the logic circuit 12 each exactly at the time when a suppression pulse $F_A$ (FIG. 3*b*) follows upon an alarm pulse A (FIG. 3*c*). In the example at present being considered this takes place for example in the fields 2 and 3, so that by reason of the short delay by the period $\Delta T$, the first alarm pulse A' (FIG. 3*d*), which originates from field 2 and which normally would result in a spurious alarm, is suppressed at the right time. The pulses in FIGS. 3*h*, 3*i* and 3*k* are obtained in the above described manner.

The position and the dimensions of the area F are so selected in any particular case that any spurious brightness changes in the picture leading to an irrelevant alarm pulse A are always, or almost always, detected by the area analyzer 10 for suppression of the pulse A. In this connection the sensitivity to brightness changes of the area analyzer 10 is sufficiently higher than that of the picture analyzer 5 that variations in picture brightness evoking the production of spurious alarm pulses A will also be almost certain to cause a response of the area analyzer 10.

I claim:

1. In an alarm system for discriminating a video signal produced by a television camera for detecting a movement or a change in a scene which is under surveillance by the television camera, the alarm system comprising means for subdividing the television picture corresponding to the video signal into a plurality of areas, and evaluation means for individually evaluating the respective video signals corresponding to those areas according to predetermined criteria, the improvement comprising means for detecting a video signal change originating from a predetermined brightness change in a selected picture area of adjustable size and position, and means for suppressing any alarm initiated in respect of at least one remaining area of the television picture when said predetermined brightness change is detected.

2. A system according to claim 1, in which the evaluation means for the video signal of the remaining area is less sensitive to brightness changes in the remaining area of the picture than the evaluation means for the video signal in the selected area.

3. A system according to claim 2, in which each individual evaluating means comprises a respective store, means adapted to effect comparison of the respective video signal with the contents of the store, and means for periodically updating the contents of the store in accordance with brightness changes.

4. A system according to claim 1, in which each individual evaluating means comprises a respective store, means adapted to effect comparison of the respective video signal with the contents of the store, and means for periodically updating the contents of the store in accordance with brightness changes.

5. An alarm system for discriminating a video signal produced by a television camera for detecting a movement or a change in a scene under surveillance by the television camera, the alarm system comprising:

masking means for subdividing a television picture field corresponding to the video signal into a selected area and a remaining area;

alarm condition analyzing means for generating an alarm pulse when there is a change in the video signal corresponding to the remaining area of the television picture;

alarm indicating means activated by the alarm generating means;

means for delaying actuation of the alarm indicating means for a single field period;

brightness condition analyzing means for comparing the brightness of the selected area to a reference brightness and for generating an alarm suppression pulse when there is a change in brightness greater than a predetermined threshold;

first suppression delay means for delaying application of the alarm suppression pulse by a time interval equal to the difference between the termination of the selected area and termination of the field;

gate means connected between the alarm indicating means and delaying means and between the alarm indicating means and the first suppression delay means for normally transmitting the alarm pulse upon application thereto and for interrupting transmission of the alarm pulse upon application of the alarm suppression pulse by the brightness comparing means coincidental with application of the alarm pulse.

6. The alarm system of claim 5 further including second suppression delaying means for delaying transmission of the alarm suppression pulse for a single field period; and further including an OR gate connected between both the first and second delaying means and the brightness comparing means for generating a pulse coincidental with the alarm pulse to interrupt the alarm pulse whereby the alarm pulse is interrupted regardless of when a variation of brightness occurs with respect to the occurrence of the selected area within the television picture field.

7. The alarm system of claim 5 or 6 wherein the alarm system includes memory means connected to the brightness analyzing means and memory means connected to the alarm condition analyzing means for comparing the selected area video signal and remaining area video signal to reference values, and wherein the alarm system further includes means connecting the memories to outputs of the analyzing means for updating the contents of the memories in accordance with changes in brightness.

* * * * *